US009149869B2

(12) United States Patent
Suzuki et al.

(10) Patent No.: US 9,149,869 B2
(45) Date of Patent: Oct. 6, 2015

(54) MIXED POWDER FOR POWDER METALLURGY AND PROCESS FOR PRODUCING SAME

(75) Inventors: Hironori Suzuki, Takasago (JP); Shinya Arima, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 210 days.

(21) Appl. No.: 13/880,285

(22) PCT Filed: Nov. 14, 2011

(86) PCT No.: PCT/JP2011/076168
§ 371 (c)(1),
(2), (4) Date: Apr. 18, 2013

(87) PCT Pub. No.: WO2012/070415
PCT Pub. Date: May 31, 2012

(65) Prior Publication Data

US 2013/0210687 A1 Aug. 15, 2013

(30) Foreign Application Priority Data

Nov. 22, 2010 (JP) ..... 2010-260127

(51) Int. Cl.
*F16C 33/12* (2006.01)
*B05D 7/00* (2006.01)
(Continued)

(52) U.S. Cl.
CPC ..... *B22F 1/0062* (2013.01); *B22F 1/02* (2013.01); *B22F 3/02* (2013.01); *C22C 33/0264* (2013.01); *B22F 2003/023* (2013.01)

(58) Field of Classification Search
CPC ..... F16C 33/12; B22F 1/02; B22F 1/0059
USPC ..... 508/103; 427/216; 75/252
See application file for complete search history.

(56) References Cited

U.S. PATENT DOCUMENTS 4,676,831 A 6/1987 Engstrom
4,946,499 A 8/1990 Sakuranda et al.
(Continued)

FOREIGN PATENT DOCUMENTS

JP 60 502158 12/1985
JP 63 206401 8/1988
(Continued)

OTHER PUBLICATIONS

U.S. Appl. No. 13/822,444, filed Mar. 12, 2013, Suzuki.
(Continued)

*Primary Examiner* — Vishal Vasisth
(74) *Attorney, Agent, or Firm* — Oblon, McClelland, Maier & Neustadt, L.L.P.

(57) ABSTRACT

A process for producing a mixed powder for powder metallurgy in which graphite segregation can be prevented and which has satisfactory flowability and brings about satisfactory lubricating properties, the process comprising: selecting an organic binder which, when the solubility of an organic lubricant in a given organic solvent at a given temperature is taken as 1, has a solubility in the same solvent at the same temperature of 2 or higher; mixing the organic lubricant and the organic binder with the given organic solvent together with an iron powder to prepare an iron-powder slurry in which the organic lubricant and the organic binder have been dissolved in the organic solvent; and removing the organic solvent from the iron-powder slurry by vaporization to precipitate the organic lubricant and the organic binder in this order.

12 Claims, 2 Drawing Sheets

(51) Int. Cl.

| | |
|---|---|
| ***B22F 1/00*** | (2006.01) |
| ***B22F 1/02*** | (2006.01) |
| ***B22F 3/02*** | (2006.01) |
| ***C22C 33/02*** | (2006.01) |

(56) References Cited

U.S. PATENT DOCUMENTS

| | | | | |
|---|---|---|---|---|
| 5,135,566 | A | 8/1992 | Sakuranda et al. | |
| 5,286,275 | A | 2/1994 | Murakami et al. | |
| 5,296,677 | A | 3/1994 | Takahashi et al. | |
| 5,525,293 | A | 6/1996 | Kagawa et al. | |
| 5,629,092 | A | 5/1997 | Gay et al. | |
| 6,136,265 | A | 10/2000 | Gay et al. | |
| 6,264,718 | B1 | 7/2001 | Akagi et al. | |
| 6,451,082 | B1 | 9/2002 | Ozaki et al. | |
| 6,485,677 | B1 | 11/2002 | Johansson et al. | |
| 7,074,254 | B2 | 7/2006 | Fujisawa et al. | |
| 7,789,934 | B2 | 9/2010 | Suzuki et al. | |
| 2003/0219617 | A1* | 11/2003 | Ozaki et al. | 428/570 |
| 2004/0038067 | A1 | 2/2004 | Ozaki et al. | |
| 2006/0090594 | A1 | 5/2006 | Fujisawa et al. | |
| 2008/0118766 | A1 | 5/2008 | Fujisawa et al. | |

FOREIGN PATENT DOCUMENTS

| | | | |
|---|---|---|---|
| JP | 1-159301 | A | 6/1989 |
| JP | 1 219101 | | 9/1989 |
| JP | 4-349602 | A | 12/1992 |
| JP | 5 86403 | | 4/1993 |
| JP | 6 49503 | | 2/1994 |
| JP | 7 173503 | | 7/1995 |
| JP | 7 228901 | | 8/1995 |
| JP | 9 71801 | | 3/1997 |
| JP | 2001-254102 | A | 9/2001 |
| JP | 2004 232079 | | 8/2004 |

OTHER PUBLICATIONS

International Search Report Issued Feb. 7, 2012 in PCT/JP11/76168 Filed Nov. 14, 2011.

* cited by examiner

MIXED POWDER FOR POWDER METALLURGY AND PROCESS FOR PRODUCING SAME

This application is a 371 of PCT/JP11/76168, filed Nov. 14, 2011.

TECHNICAL FIELD

The present invention relates to a powder metallurgy technology for producing a sintered body by molding and sintering an iron-base powder, in particular to a mixed powder for powder metallurgy which can suppress the segregation and dust emission of graphite and has both the flowability and lubricity of the mixed powder.

BACKGROUND ART

In powder metallurgy for producing a sintered body by using an iron powder or a copper powder as the main raw material, generally a mixed powder containing the powder of a main raw material, an auxiliary material powder (a graphite powder, an alloy component, etc.) for improving the physical property of the sintered body, a lubricant, and others is used. In order to improve the mechanical properties (strength, hardness, etc.) of a sintered body in particular, generally a means of adding a carbon supply component (carbon source) such as graphite, molding a material powder, and successively dispersing the carbon source in an iron powder and carburizing the iron powder during heat sintering process is adopted.

Since graphite has a smaller specific gravity and a smaller grain size than an iron powder however, a problem is that, only by mixing them, the graphite is largely separated from the iron powder, the graphite segregates, and they cannot be mixed homogeneously. In powder metallurgy, generally a mixed powder is stored in a storage hopper in advance for mass-producing sintered bodies. In a storage hopper, graphite having a small specific gravity tends to segregate at the upper part of the hopper and, when a mixed powder is discharged from the hopper, the concentration of the graphite increases toward the end of the discharge from the hopper. As a result, a part having a high carbon concentration is formed in a sintered body, a cementite structure precipitates there, and mechanical properties deteriorate. If a carbon content varies by the segregation of graphite in a sintered body, parts having a stable quality can hardly be produced. Further an arising problem in a mixing process and a molding process is that the segregated graphite powder causes dust emission, and the deterioration of a work environment and the lowering of the handleability of a mixed powder are caused. Such segregation is caused not only in the case of graphite but also in the cases of various kinds of powders mixed with an iron powder likewise and the prevention of the segregation is desired.

In order to prevent such segregation and dust emission, roughly three methods have heretofore been proposed. The first method is a method of adding a liquid additive such as tall oil to a mixed powder (for example, Patent Literatures 1 and 2). The method has an advantage that a mixed powder can be produced with simple equipment but a problem of the method is that, if a liquid additive of a quantity necessary for exhibiting a segregation prevention effect is added, a liquid bridge force acts among iron particles and flowability deteriorates extremely. The second method is a method of vaporizing a solvent and attaching graphite onto the surface of an iron powder after dissolving a solid binder such as a high molecular weight polymer into the solvent and homogenously mixing them (Patent Literatures 3 and 4 and others). The method has the advantages that graphite can stick without fail and there are many choices in adopting a lubricant used but the flowability of a mixed powder may be insufficient depending on some quantities or some types. The third method is a so-called hot melt method characterized by heating and melting a lubricant of a relatively low molecular weight such as fatty acid while it is mixed with an iron powder (for example, Patent Literature 5). The drawback of the method is that the temperature control during mixing is very important for uniformly sticking the melted lubricant onto the surface of the iron powder and the number of choices for a usable lubricant is restricted.

For preventing the segregation and dust emission of graphite, adhesive force between an iron powder and graphite is required to be enhanced but other characteristics are also required in recent years and the types and degrees of the characteristics have increasingly been upgraded. As one of the required characteristics, the flowability of powder is named. In powder metallurgy, the flowability of a mixed powder is one of the important characteristics when the mixed powder is discharged from a storage hopper or when a mold is filled with the mixed powder. That is, if the flowability of a mixed powder is inferior, the arising problems are that bridging is caused at the upper part of the outlet in a hopper, thus the discharge is hindered, and a hose clogs between the hopper and a shoebox. Further, in the case of a mixed powder having a poor flowability, even when the mixed powder is outpoured forcibly from a hose, a mold, particularly a part of thin-wall, is not filled and a sound molded body may not be produced in some cases.

The flowability of a mixed powder is influenced also by the grain size and shape of the metal powder used, the type, quantity, grain size, and shape of a physical property improving agent to be added, and others and the most influencing factors are considered to be the quantity of a powdery lubricant added and the type of a lubricant added to the mixed powder.

With regard to the quantity of an added powdery lubricant, generally flowability deteriorates from its peak at 0.1% by mass of the added lubricant as the quantity of the added lubricant increases and hence it is preferable to lower the quantity of the added lubricant from the viewpoint of securing the flowability. If the quantity of the added lubricant decreases however, the lubricity lowers considerably as a matter of course, the friction coefficient between a molded body and a mold face increases when the molded body is extracted from a mold, and that causes die seizure and mold damage. Consequently, it has been difficult to obtain both lubricity and flowability simultaneously.

Further, it is difficult to obtain both lubricity and flowability simultaneously also from the viewpoint of the type and melting point of a lubricant. That is, stearic acid or stearic acid amide generally having a low melting point is excellent in lubricity but, in a lubricant having such a low melting point, aggregation is caused and flowability deteriorates in some cases. When an ambient temperature is high in particular, the drawback appears conspicuously. In contrast, metallic soap or ethylene bis-amide having a high melting point can maintain a good flowability even when an ambient temperature rises but lubricity is inferior to the stearic acid amide or the like having a low melting point.

In this way, in consideration of the quantity and type of a lubricant added, to materialize a mixed powder having both lubricity and flowability simultaneously has been a long-term challenge.

CITATION LIST

Patent Literature

Patent Literature 1: JP-A No. S60(1985)-502158
Patent Literature 2: JP-A No. H6(1994)-49503
Patent Literature 3: JP-A No. H5(1993)-86403
Patent Literature 4: JP-A No. H7(1995)-173503
Patent Literature 5: JP-A No. H1(1989)-219101

DISCLOSURE OF THE INVENTION

Problem to be Solved by the Invention

In view of the above situation, an object of the present invention is to provide: a mixed powder for powder metallurgy having good flowability and lubricity; and a process for producing the mixed powder.

Means for Solving the Problem

A production process according to the present invention that solves the above problems comprises the processes of: selecting an organic binder which, when the solubility of an organic lubricant at a given temperature in a given organic solvent is regarded as 1, has a solubility of 2 or higher at the given temperature in the given solvent; mixing the organic lubricant and the organic binder with the given organic solvent together with an iron powder to prepare an iron-powder slurry in which the organic lubricant and the organic binder are dissolved in the organic solvent; and removing the organic solvent from the iron-powder slurry by vaporization to precipitate the organic lubricant and the organic binder in this order.

In a production process according to the present invention, it is preferable that, when the ratio of the solubility of the organic binder to the solubility of the organic lubricant (the former/the latter) is represented by a, the quantity of the organic binder is less than 100×a per 100 parts by mass of the organic lubricant.

It is preferable that: the organic solvent is an aromatic hydrocarbons organic solvent; the organic binder is fatty acid ester represented by the structure expression (1) below; and the organic lubricant is fatty acid amide represented by the structure expression (2) below. Further, it is preferable that the fatty acid amide is hexadecanoic acid amide, (N-octadecenyl) hexadecanoic acid amide, or (N-octadecyl) docosenoic acid amide.

[Ch.1]

$$R^1COO—CH_2—CH_2—OCOR^2 \quad (1)$$

[Ch.2]

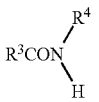

(2)

(in the expressions, $R^1$ and $R^2$ represent aliphatic hydrocarbon groups identical to or different from each other, $R^3$ represents an aliphatic hydrocarbon group, and $R^4$ represents a hydrogen atom or a hydrocarbon group).

Furthermore, it is preferable that the iron-powder slurry further contains a high-molecular antistatic agent and it is yet preferable that the high-molecular antistatic agent is: a styrene synthetic rubber copolymer containing 5 to 95 parts by mass of styrene and 95 to 5 parts by mass of butadiene and/or isoprene as monomer components; or a hydride thereof.

The present invention includes a mixed powder for powder metallurgy obtained through the above production process. The present invention further includes a mixed powder for powder metallurgy wherein an iron powder is covered with an organic lubricant and an organic binder. It is preferable that the proportion of the organic lubricant is larger on the inner side than on the outer side of the coating layer with which the iron powder is covered.

Effect of the Invention

A production process according to the present invention makes it possible: to obtain a mixed powder for powder metallurgy wherein an iron powder is covered with an organic lubricant and an organic binder; and to give both flowability and lubricity to the mixed powder for powder metallurgy. Further, when graphite is used in a production process according to the present invention, it is possible to prevent the graphite from segregating.

BEST MODE FOR CARRYING OUT THE INVENTION

Figure 1:
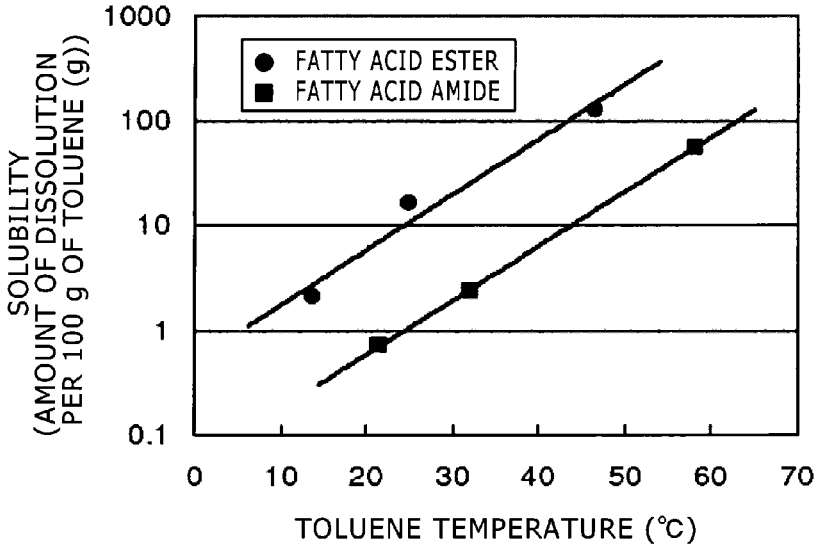
FIG. 1 is a graph showing the solubility of hexadecanoic acid amide and the solubility of stearic acid diester of ethylene glycol in toluene.

A production process according to the present invention is largely characterized by (i) mixing both an organic lubricant and an organic binder with an iron powder and (ii) selecting the organic binder and the organic lubricant so that the solubilities of them may be largely different from each other in a given organic solvent and the solubility of the organic binder may be higher than that of the organic lubricant. By so doing, it is possible to cover the iron powder with both the organic lubricant and the organic binder and obtain both the characteristics of lubricity and flowability. Further, although the organic lubricant and the organic binder used in the present invention have both the characteristics of lubricity and flowability respectively, generally an organic matter having a higher solubility shows a better effect in improving flowability, thus the organic binder having a high solubility, namely having a good flowability, precipitates afterward in the present invention, and hence the flowability of the mixed powder can be maximized. Further, when a mixed powder for powder metallurgy according to the present invention contains a carbon source such as graphite, both the organic binder and the organic lubricant in the present invention have the function as a binder and hence the segregation of the graphite can also be prevented by the existence of them. Here, lubricity: means the magnitude of friction when a molded body is produced by forming a mixed powder with a mold and the molded body is extracted from the mold; and can be evaluated for example by an extraction pressure which will be shown in an example described later. Meanwhile, flowability: means the mobility of a mixed powder; and can be evaluated for example by a fluidity and a critical discharging diameter which will be shown in an example described later.

An organic lubricant and an organic binder are selected in the following manner. That is, a combination is selected so that, in accordance with an organic solvent used, when the solubility of an organic lubricant is regarded as 1 at a given temperature, the solubility of an organic binder may be 2 or higher at the same given temperature. Here, a given temperature may be set in the temperature range used when an organic lubricant and an organic binder are mixed with a used organic solvent and dissolved.

Organic solvents are classified into an alcohol system, an ester system, an ether system, an amide system, a ketone system, an aromatic hydrocarbon system, an aliphatic hydrocarbon system, etc. As alcohol system organic solvents, for example methanol, ethanol, propanol, butanol, etc. are named. As ester system organic solvents, for example ethyl acetate, butyl acetate, etc. are named. As ether system organic solvents, for example dimethyl ether, methylethyl ether, tetrahydrofuran, ethylene glycol dimethyl ether, etc. are named. As amide system organic solvents, for example dimethylformamide, dimethylacetamide, acetanilide, etc. are named. As ketone system organic solvents, for example acetone, methyl ethyl ketone, etc. are named. As aromatic hydrocarbon system organic solvents, for example benzene, toluene, xylene, etc. are named. As aliphatic hydrocarbon system organic solvents, for example hexane, heptane, etc. are named. A preferable organic solvent is an aromatic hydrocarbon system organic solvent, yet preferably toluene.

In the present invention, an organic lubricant and an organic binder are selected so as to satisfy the aforementioned relationship of the solubility in accordance with the type of an organic solvent as stated above. As a preferable organic binder, a fatty acid ester represented by the expression (1) shown below is named and, as a preferable organic lubricant, a fatty acid amide represented by the expression (2) shown below is named.

[Ch. 3]

$$R^1COO—CH_2—CH_2—OCOR^2 \quad (1)$$

[Ch. 4]

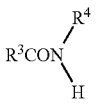

(2)

(in the expressions, $R^1$ and $R^2$ represent aliphatic hydrocarbon groups identical to or different from each other, $R^3$ represents an aliphatic hydrocarbon group, and $R^4$ represents a hydrogen atom or a hydrocarbon group)

A fatty acid ester represented by the expression (1) can formally be regarded as a substance obtained by esterifying ethylene glycol and a kind of fatty acid but may be a substance produced by another method. As $R^1$ and $R^2$, a saturated hydrocarbon group (alkyl group) and an unsaturated hydrocarbon group (alkenyl group or alkynyl group) are named. The number of unsaturated bonds in an unsaturated hydrocarbon group may be either one or plural (for example, about 2 to 6, preferably about 2 to 3). Each of $R^1$ and $R^2$ is preferably an alkyl group and yet preferably an alkyl group having a carbon number of 12 or more. If a carbon number is 11 or less, a fatty acid ester (diester) represented by the expression (1) is in the state of a liquid or a semisolid (grease) and the flowability deteriorates.

As $R^1$ and $R^2$, for example saturated hydrocarbon groups including a tridecyl group, a tetradecyl group, a pentadecyl group, a hexadecyl group, a heptadecyl group, an octadecyl group, a nonadecyl group, an icosyl group, a docosyl group, a tetracosyl group, a hexacosyl group, an octacosyl group, a triacontyl group, etc. and unsaturated hydrocarbon groups including an octadesylidene group, an icosylidene group, etc. are named. Each of $R^1$ and $R^2$ is preferably an octadecyl group and both fatty acids comprising $R^1$ and $R^2$ respectively are preferably stearic acid.

A fatty acid amide represented by the expression (2) can formally be regarded as a dehydrated product of $R^3COOH$ and $R^4NH_2$ but may be a substance produced by another method. As $R^3$, like $R^1$ or $R^2$, a saturated hydrocarbon group (alkyl group) and an unsaturated hydrocarbon group (alkenyl group or alkynyl group) are named. The number of unsaturated bonds in an unsaturated hydrocarbon group may be either one or plural (for example about 2 to 6, preferably about 2 to 3). $R^3$ is preferably an alkyl group or an alkenyl group. The hydrocarbon group is preferably in the state of a straight chain but may also be formed by replacing a carbon atom constituting a straight chain (main chain) with one or more lower alkyl groups (for example alkyl groups each of which having a carbon number of 1 to 6, particularly about 1 to 3). The carbon number of a hydrocarbon group is preferably not less than 8 to not more than 24. In the case of being replaced with a lower alkyl group, the carbon number of the main chain is not less than 5 to not more than 26 for example. $R^4$ can be selected from the range similar to $R^3$ and may otherwise be a hydrogen atom. $R^4$ is preferably an alkyl group, an alkenyl group, or a hydrogen atom.

When $R^3$ is an alkyl group, for example an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a henicosyl group, a docosyl group, a tricosyl group, a tetracosyl group, etc. are named. $R^3$ is preferably a hexadecyl group and, as a fatty acid comprising $R^3$, hexadecanoic acid is named.

When $R^3$ is an alkenyl group, for example an octylidene group, a nonylidene group, a decylidene group, an undecylidene group, a dodecylidene group, a tridecylidene group, a tetradecylidene group, a pentadecylidene group, a hexadecylidene group, a heptadeylidene group, an octadecylidene group, a nonadecylidene group, an icosylidene group, a docosylidene group, a tetracosylidene group, etc. are named. $R^3$ is preferably a docosylidene group and, as a fatty acid comprising $R^3$, docosenoic acid is named.

When $R^4$ is an alkyl group, the same substances as $R^3$ are named. $R^4$ is preferably an octadecyl group and, as an amine comprising $R^4$, octadecylamine is named. When $R^4$ is an alkenyl group, the same substances as $R^3$ are named likewise. $R^4$ is preferably an octadecylidene group and, as an amine comprising $R^4$, octadecenylamine is named.

Examples of a preferable fatty acid amide represented by the expression (2) are hexadecanamide, (N-octadecenyl) hexadecanamide, and (N-octadecyl) docosenamide.

An organic lubricant and an organic binder selected in the manner described above are mixed with a given organic solvent together with an iron powder to prepare an iron-powder slurry. In the iron-powder slurry, both the organic lubricant and the organic binder are dissolved in the organic solvent. Successively, the organic solvent is vaporized from the iron-powder slurry. By so doing, the organic lubricant having a lower solubility precipitates firstly on the surface of the iron powder and the organic binder precipitates secondly. The ratio of the solubility of the organic binder to that of the organic lubricant (the former/the latter) at a given temperature in a given solvent is preferably 5 or higher and yet preferably 8 or higher (still yet preferably 10 or higher). The upper limit of the ratio of the solubility is not particularly limited but is 20 or lower for example.

When an iron-powder slurry is prepared, the order of the mixing of an organic lubricant, an organic binder, an iron powder, and an organic solvent is not particularly limited and for example it is possible to: charge and stir an iron powder in a mixer; and, during the stirring, add an organic solvent in which an organic lubricant and an organic binder are dissolved to the iron powder by means of instillation or atomization.

A method for vaporizing an organic solvent is not particularly limited, a method of flowing a dried gas or a method of heating an iron-powder slurry are named, and a method of heating an iron-powder slurry is preferable. Pressure on that occasion is not particularly limited too, the atmospheric pressure or a reduced pressure may be adopted, and a preferable pressure is a reduced pressure of 650 mmHg or lower in degree of vacuum. When an organic solvent is vaporized, for example an iron-powder slurry may be heated to 40° C. to 80° C., and the quantity of the organic solvent after it is dried is preferably not more than 0.1% of the quantity of the organic solvent before it is dried.

In order to precipitate an organic lubricant and an organic binder in this order, it is preferable to further adjust the quantities of them added. Specifically, when the ratio of the solubility of an organic binder to the solubility of an organic lubricant (the former/the latter) is regarded as a, the quantity of the organic binder is preferably less than 100×a, yet preferably not more than 75×a, and still yet preferably not more than 50×a, per 100 parts by mass of the organic lubricant. For example when the ratio of the solubility of an organic binder to the solubility of an organic lubricant (the former/the latter) is 8 or higher at a given temperature in a given solvent, the quantity of the organic binder can be 25 to 400 parts by mass, yet preferably 65 to 225 parts by mass, and still yet preferably 80 to 130 parts by mass, per 100 parts by mass of the organic lubricant.

Further, the total quantity of an organic lubricant and an organic binder: is decided in accordance with the quantity of graphite and the quantity of other powder that will be described later; and is preferably 0.3 to 2.0 parts by mass per 100 parts by mass of an iron powder. If the total quantity of an organic lubricant and an organic binder is less than 0.3 part by mass, the effect of improving flowability is exhibited insufficiently and, if it exceeds 2.0 parts by mass in contrast, compressibility (molded body density) is ill-affected.

When an iron powder is covered with an organic lubricant and an organic binder as stated above, the powder may sometimes be electrostatically charged by friction among the powder particles or the like. The static electricity is neutralized with the lapse of time but, since the static electricity affects flowability, it is preferable that the powder is not electrostatically charged. As methods for preventing electrostatic charge, a method of installing a neutralization apparatus such as an ionizer and a method of adding a surfactant or a high-molecular antistatic agent are named and particularly a method of adding a high-molecular antistatic agent is preferably adopted. By using a high-molecular antistatic agent, it is possible to suppress the electrification of a powder and prevent flowability from deteriorating. As a high-molecular antistatic agent, for example such styrene synthetic rubber or hydride thereof as disclosed in Japanese Patent No. 289461 can be used. The weight-average molecular weight thereof is for example not less than 10,000 and preferably 50,000 to 200,000. The quantity of an added antistatic agent is about 0.01 to 3 parts by mass and preferably 0.03 to 1 part by mass per 100 parts by mass of an iron powder for example. If the quantity of an added antistatic agent is less than 0.01 part by mass, the effect of preventing electrification is obtained insufficiently and, if it exceeds 3 parts by mass in contrast, compressibility (molded body density) may sometimes be ill-affected.

A mixed powder for powder metallurgy may contain a carbon source such as graphite, an alloying powder, etc. if necessary. As an alloying powder, for example a powder containing at least one kind selected from the group of copper, nickel, chromium, molybdenum, phosphorus, and sulfur is named. Specific examples are a copper powder, a nickel powder, a chromium powder, a molybdenum powder, a phosphorus alloy powder, a sulfur-containing powder, etc. The content of a carbon source is for example 0.5 to 3 parts by mass per 100 parts by mass of an iron powder. An alloying powder may be used either solely or in combination of two or more kinds and the content is for example 1 to 5 parts by mass, yet preferably 1.5 to 3 parts by mass, per 100 parts by mass of an iron powder.

In the production process according to the present invention, when graphite, an antistatic agent, and an alloying powder are further added, for example a method of, when an iron-powder slurry is prepared, charging those materials into a mixer together with an iron powder, stirring them, and adding an organic solvent in which an organic lubricant and an organic binder are dissolved to them is used.

Here, an iron powder used in the present invention may be either a pure iron powder or an iron alloy powder. The iron alloy powder may be either a partially-alloyed powder formed by dispersively attaching an alloying powder (for example copper, nickel, chromium, molybdenum, or the like) onto the surface of an iron-base powder or a prealloy powder obtained from molten iron (or molten steel) containing an alloying component. The iron-base powder is usually produced by atomizing molten iron or molten steel. Otherwise, the iron-base powder may also be a reduced-iron powder produced by reducing iron ore or mill scale.

In a mixed powder for powder metallurgy obtained through a production process according to the present invention, an organic lubricant and an organic binder precipitate in sequence on the surface of an iron powder and the mixed powder has an excellent lubricity but, with the aim of further improving the lubricity, it is possible to further use a powdered lubricant such as metallic soap (for example zinc stearate), wax (for example ethylene bis-amide), or polyhydroxy carboxylic acid amide (for example disclosed in WO2005/068588) in combination. Such a powdered lubricant can be added after an organic solvent is vaporized from an iron-powder slurry.

A mixed powder according to the present invention: can be applied to a sintered part for machine structural use and the like, in particular preferably applied to a part having a complicated thin-wall shape; has a good sintered body density; and hence can reduce weight and enhance strength.

EXAMPLE

The present invention is hereunder explained more concretely in reference to examples. The present invention is not restricted by the following examples, it is needless to say that the present invention can be modified appropriately within a range conforming to anteroposterior tenors, and the modifications are all included in the technological scope of the present invention.

Example 1

Organic lubricants and organic binders having solubilities two times or more different from each other at a given temperature are investigated by using toluene as an organic solvent. As a result, it is found that, when hexadecanoic acid amide is selected as an organic lubricant and stearic acid diester of ethylene glycol is selected as an organic binder, the solubility of the stearic acid diester of ethylene glycol is about 10 times the solubility of the stearic acid diester of ethylene glycol in a temperature range of approximately 10° C. to 60° C. FIG. 1 is a graph showing the solubilities of hexadecanoic acid amide and stearic acid diester of ethylene glycol in toluene in a temperature range of 10° C. to 60° C. Here in FIG. 1, "fatty acid ester" represents stearic acid diester of ethylene glycol and "fatty acid amide" represents hexadecanoic acid amide.

mass of styrene and 65 parts by mass of butadiene is used as an antistatic agent. The quantities of the added copper powder and graphite powder are 2 and 0.8 parts by mass respectively per 100 parts by mass of the iron powder.

Here for comparison, an example of using only styrene butadiene copolymer (Experiment No. 4) and an example of using only stearic acid diester of ethylene glycol (Experiment No. 5) as the organic compound to be dissolved in the toluene solution are also tested. The quantity of each of the materials added per 100 parts by mass of the iron powder is shown in Table 1.

In each of Experiment Nos. 1 to 5, after the organic solvent is dried, a lubricant in a powder state described in Table 1 is added and mixed (mixed while being stirred at a high speed for two minutes in the mixer with blades), thus a sample material for measuring powder characteristics is produced, and the characteristics are measured by the following methods. Here, since fatty acid ester and fatty acid amide are dissolved in toluene and mixed in a temperature range of 10° C. to 60° C., the solubilities in a temperature range of 10° C. to 60° C. are the subjects to be concerned.

TABLE 1

| Experiment No. | Organic binder | Organic lubricant | Antistatic agent | Organic solvent | Lubricant powder |
|---|---|---|---|---|---|
| Experiment No. 1 | 0.2 part by mass of stearic acid diester of ethylene glycol | 0.2 part by mass of hexadecanoic acid amide | — | 2 parts by mass of toluene | 0.4 part by mass of ethylene bis-amide |
| Experiment No. 2 | 0.2 part by mass of stearic acid diester of ethylene glycol | 0.2 part by mass of hexadecanoic acid amide | 0.05 part by mass of styrene butadiene copolymer | 2 parts by mass of toluene | 0.4 part by mass of ethylene bis-amide |
| Experiment No. 3 | 0.2 part by mass of stearic acid diester of ethylene glycol | 0.2 part by mass of hexadecanoic acid amide | 0.05 part by mass of styrene butadiene copolymer | 2 parts by mass of toluene | 0.4 part by mass of polyhydroxy carboxylic acid amide |
| Experiment No. 4 | 0.1 part by mass of styrene butadiene copolymer | — | — | 2 parts by mass of toluene | 0.8 part by mass of ethylene bis-amide |
| Experiment No. 5 | 0.2 part by mass of stearic acid diester of ethylene glycol | — | — | 2 parts by mass of toluene | 0.8 part by mass of ethylene bis-amide |

*The quantity of each of the added materials is represented by the rate per 100 parts by mass of iron powder.

Figure 2:
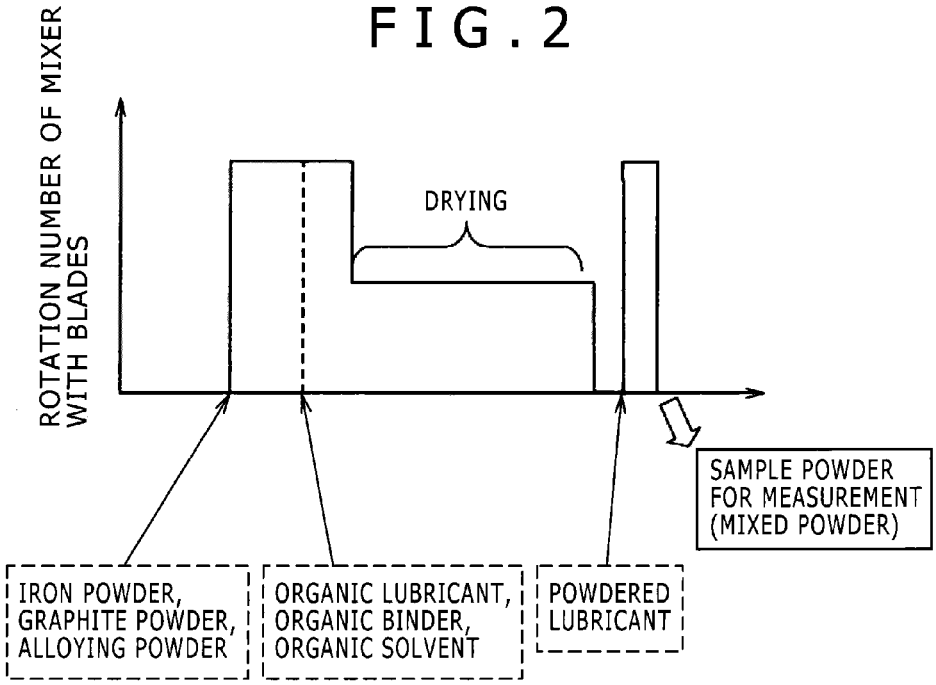
FIG. 2 is a flow chart showing the procedure of an experiment in an example described later.
Figure 3:
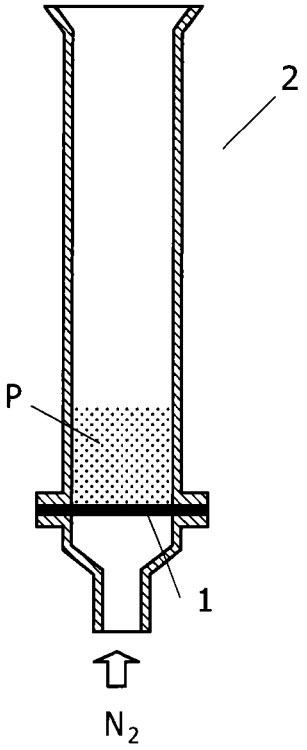
FIG. 3 is a sectional view of a graphite scattering rate measuring device used in an example described later.

Iron powder (Atmel 300M produced by Kobe Steel, Ltd., grain size: 180 μm or under), copper powder (CE-15 produced by Fukuda Metal Foil & Powder Co., Ltd.), and graphite powder (JCPB produced by Nippon Graphite Industries, Ltd.) are charged into a mixer with blades and strongly stirred at a high speed for five minutes while a toluene solvent in which two (Experiment No. 1) or three (Experiment Nos. 2 and 3) kinds of organic compounds are dissolved is dripped or sprayed. Successively, the stirring is switched to a gentle mode and retained for about 10 minutes under a reduced pressure while warm water of 60° C. is circulated through the jacket of the mixer and thus the solvent is dried and removed. FIG. 2 shows the mixing procedure. The two kinds of organic compounds are hexadecanoic acid amide (PNT produced by Nippon Fine Chemical Co., Ltd.) and stearic acid diester of ethylene glycol (EGDS produced by Nippon Fine Chemical Co., Ltd.) and in a case of using three kinds of organic compounds, in addition to the two kinds of organic compounds, a styrene butadiene copolymer (TR 2001C produced by JSR Co., Ltd., molecular weight: 100,000) comprising 35 parts by (1) Measurement of Graphite Scattering Rate As shown in FIG. 3, a Nuclepore filter 1 (mesh size: 12 rim) is set in a glass tube 2 (inside diameter: 16 mm, height: 106 mm) the lower part of which has a funnel shape, 25 g of a sample powder P is charged into it, $N_2$ gas is fed from the bottom of the glass tube 2 at a rate of 0.8 liter per minute for 20 minutes, and a graphite scattering rate is obtained through the following expression (3).

$$\text{Graphite scattering rate (\%)} = (1 - \text{carbon quantity after } N_2 \text{ gas flow/carbon quantity before } N_2 \text{ gas flow}) \times 100 \quad (3)$$

(2) Measurement of Apparent Density

The apparent density (g/cm$^3$) of a sample powder is measured in accordance with JIS Z2504 (apparent density testing method for metal powder).

(3) Measurement of Flowability

The fluidity (sec./50 g) of a mixed powder is measured in accordance with JIS Z2502 (fluidity testing method for metal powder). That is, a time (sec.) spent until 50 g of a mixed powder flows out through an orifice of 2.63 mmϕ is measured and the time (sec.) is defined as the fluidity of the mixed powder.

Further, a cylinder-shaped container 114 mm in inside diameter and 150 mm in height having an outlet of a variable discharge diameter at the bottom is filled with 2 kg of a sample powder in the state of closing the outlet and retained for 10 minutes. Successively, the outlet is opened gradually, the smallest diameter capable of discharging the sample powder is measured, and the smallest diameter is defined as a critical discharging diameter.

A smaller fluidity (sec.) and a smaller critical discharging diameter mean a more superior flowability.

(4) Measurement of Molded Body Density

A columnar molded body of 25 mmϕ and a height of 15 mm is formed by compressing a sample powder at the ordinary temperature (25° C.) under a pressure of 490.3 MPa (5 T/cm$^2$) and a molded body density (g/cm$^3$) is measured in accordance with JSPM (Japan Society of Powder and Powder Metallurgy) Standard 1-64 (compression testing method for metal powder).

(5) Measurement of Extraction Pressure

An extraction pressure (MPa) is obtained by dividing a load needed for extracting a molded body obtained when a molded body density is measured from a mold by a contact area between the mold and the molded body. A smaller extraction pressure means a more superior lubricity.

The results are shown in Table 2.

TABLE 2

| Experiment No. | Graphite scattering rate (%) | Apparent density (g/cm$^3$) | Fluidity (sec.) | Critical discharging diameter (mm) | Molded body density (g/cm$^3$) | Extraction pressure (MPa) |
|---|---|---|---|---|---|---|
| 1 | 0 | 3.25 | 25.2 | 12.5 | 6.98 | 8.8 |
| 2 | 1 | 3.23 | 24.8 | 12.5 | 6.98 | 8.9 |
| 3 | 0 | 3.33 | 24.1 | 10.0 | 6.99 | 7.9 |
| 4 | 0 | 3.12 | 29.8 | 30.0 | 6.97 | 10.2 |
| 5 | 5 | 3.15 | 31.3 | 25.0 | 6.97 | 10.8 |

In each of Experiment Nos. 1 to 3, since both an organic binder and an organic lubricant are used, the fluidity and the critical discharging diameter are small and the extraction pressure is also small in comparison with Experiment Nos. 4 and 5 in which only organic binders are used but no organic lubricants are used. That is, it is found that the flowability and the lubricity are superior in each of Experiment Nos. 1 to 3.

Example 2

The organic lubricants and the organic binders are blended as shown in Table 3 and the characteristics of the sample powders are measured in the same manner as Example 1. The results are shown in Table 4.

TABLE 3

| Experiment No. | Organic binder | Organic lubricant | Antistatic agent | Organic solvent | Lubricant powder |
|---|---|---|---|---|---|
| Experiment No. 6 | 0.2 part by mass of stearic acid diester of ethylene glycol | 0.2 part by mass of hexadecanoic acid amide | 0.05 part by mass of styrene butadiene copolymer | 2 parts by mass of toluene | 0.4 part by mass of ethylene bis-amide |
| Experiment No. 7 | 0.2 part by mass of stearic acid diester of ethylene glycol | 0.3 part by mass of hexadecanoic acid amide | 0.05 part by mass of styrene butadiene copolymer | 2 parts by mass of toluene | 0.4 part by mass of polyhydroxy carboxylic acid amide |
| Experiment No. 8 | 0.3 part by mass of stearic acid diester of ethylene glycol | 0.1 part by mass of hexadecanoic acid amide | 0.05 part by mass of styrene butadiene copolymer | 2 parts by mass of toluene | 0.4 part by mass of polyhydroxy carboxylic acid amide |

*The quantity of each of the added materials is represented by the rate per 100 parts by mass of iron powder.

TABLE 4

| Experiment No. | Graphite scattering rate (%) | Apparent density (g/cm$^3$) | Fluidity (sec.) | Critical discharging diameter (mm) | Molded body density (g/cm$^3$) | Extraction pressure (MPa) |
|---|---|---|---|---|---|---|
| 6 | 1 | 3.23 | 24.8 | 12.5 | 6.98 | 8.9 |
| 7 | 2 | 3.30 | 26.1 | 15.0 | 6.98 | 6.8 |
| 8 | 0 | 3.22 | 23.2 | 10.0 | 6.98 | 9.6 |

It is found from Table 4 that good flowability and lubricity are shown in each of Experiment Nos. 6 to 8 and, in particular, the lubricity is good (namely the extraction pressure is small) when the quantity of fatty acid amide is larger than the quantity of fatty acid ester (Experiment No. 7) and the flowability is good (namely both the fluidity and the critical discharging diameter are small) when the quantity of fatty acid ester is larger than the quantity of fatty acid amide inversely (Experiment No. 8). Consequently, it is preferable that the quantities of both the blended materials are appropriately adjusted in response to the required characteristics and, in order to obtain both the effects of an organic binder and an organic lubricant simultaneously, it is preferable that the quantities of both the blended materials are nearly equal.

Explanation of References

1 Nuclepore filter

2 Glass tube

The invention claimed is:

1. A process for producing a mixed powder for powder metallurgy, the process comprising:

mixing an organic lubricant and an organic binder with an organic solvent together with an iron powder to prepare an iron-powder slurry, wherein the organic lubricant and the organic binder are dissolved in the organic solvent and a ratio of a solubility of the organic binder to a solubility of the organic lubricant is 2 or higher; and removing the organic solvent from the iron-powder slurry by vaporization to precipitate the organic lubricant and the organic binder in this order so that the iron powder is first coated with precipitates of the organic lubricant and then coated with precipitates of the organic binder.

2. The process according to claim 1, wherein a quantity of the organic binder is less than 100=A per 100 parts by mass of the organic lubricant, where A represents the ratio of the solubility of the organic binder to the solubility of the organic lubricant.

3. The process according to claim 1, wherein the organic lubricant and the organic binder are mixed so as to be 0.3 to 2.0 parts by mass in total per 100 parts by mass of the iron powder.

4. The process according to claim 1, wherein:

the organic solvent is an aromatic hydrocarbon organic solvent;

the organic binder is a fatty acid ester represented by expression (I); and the organic lubricant is a fatty acid amide represented by expression (II), $$R^1COO—CH_2—CH_2—OCOR^2 \quad (I)$$

-continued $$R^3CON(R^4)H \quad (II)$$

where:

$R^1$ and $R^2$ each is independently an aliphatic hydrocarbon group, $R^3$ is an aliphatic hydrocarbon group, and $R^4$ is a hydrogen atom or a hydrocarbon group.

5. The process according to claim 1, wherein the iron-powder slurry further comprises a high-molecular antistatic agent.

6. The process according to claim 5, wherein the high-molecular antistatic agent is:

a styrene synthetic rubber copolymer comprising 5 to 95 parts by mass of styrene and 95 to 5 parts by mass of at least one monomer component of butadiene and isoprene; or a hydride thereof.

7. The process according to claim 1, wherein the organic lubricant is hexadecanoic acid amide, (N-octadecenyl) hexadecanoic acid amide, or (N-octadecyl) docosenoic acid amide.

8. A mixed powder for powder metallurgy obtained by the process according to claim 1.

9. A mixed powder for powder metallurgy, the mixed powder comprising:

an iron powder covered with a coating layer comprising an organic lubricant and an organic binder, wherein a proportion of the organic lubricant is larger on an inner side than on an outer side of the coating layer.

10. The process according to claim 1, wherein a quantity of the organic lubricant is nearly equal to a quantity of the organic binder.

11. The mixed powder according to claim 9, wherein a total quantity of the organic lubricant is nearly equal to a total quantity of the organic binder.

12. The mixed powder according to claim 9, wherein the organic binder is a fatty acid ester represented by expression (I); and the organic lubricant is a fatty acid amide represented by expression (II), $$R^1COO—CH_2—CH_2—OCOR^2 \quad (I)$$

$$R^3CON(R^4)H \quad (II)$$

where:

$R^1$ and $R^2$ each is independently an aliphatic hydrocarbon group, $R^3$ is an aliphatic hydrocarbon group, and $R^4$ is a hydrogen atom or a hydrocarbon group.

* * * * *